US008443489B2

(12) United States Patent
Sir Louis

(10) Patent No.: US 8,443,489 B2
(45) Date of Patent: May 21, 2013

(54) APPLIANCE HINGE COUNTERBALANCE ASSEMBLY

(75) Inventor: Nicholas R. Sir Louis, Medina, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 389 days.

(21) Appl. No.: 12/701,109

(22) Filed: Feb. 5, 2010

(65) Prior Publication Data

US 2010/0236021 A1 Sep. 23, 2010

Related U.S. Application Data

(60) Provisional application No. 61/150,144, filed on Feb. 5, 2009.

(51) Int. Cl.
*E05F 1/08* (2006.01)
*E05F 1/105* (2006.01)
*F23M 7/00* (2006.01)

(52) U.S. Cl.
USPC ..... 16/286; 16/306; 16/307; 16/287; 16/288; 126/190; 126/191; 126/194

(58) Field of Classification Search
USPC .... 16/277, 304, 286–288, 306, 317; 126/191, 126/194, 190, 192
See application file for complete search history.

(56) References Cited

U.S. PATENT DOCUMENTS

| | | | | |
|---|---|---|---|---|
| 1,634,358 | A * | 7/1927 | Hobson | 126/191 |
| 2,173,422 | A * | 9/1939 | Lucas | 116/52 |
| 3,749,080 | A * | 7/1973 | Kleinhenn | 126/191 |
| 4,269,165 | A * | 5/1981 | Wrotny et al. | 126/191 |
| 4,658,473 | A * | 4/1987 | Schema | 16/290 |
| 6,397,836 | B1 * | 6/2002 | Pelletier et al. | 126/194 |
| 6,442,799 | B1 | 9/2002 | Duarte et al. | |
| 6,637,319 | B1 * | 10/2003 | Vanini et al. | 99/467 |
| 7,243,396 | B2 | 7/2007 | Vanini | |
| 2006/0032019 | A1 * | 2/2006 | Kistner et al. | 16/286 |
| 2006/0053589 | A1 * | 3/2006 | Vanini | 16/286 |
| 2009/0064458 | A1 * | 3/2009 | Vanini | 16/304 |
| 2011/0146654 | A1 * | 6/2011 | Basavalingappa Mudbasal et al. | 126/194 |

FOREIGN PATENT DOCUMENTS

| | | |
|---|---|---|
| EP | 0 149 937 | 12/1984 |

* cited by examiner

*Primary Examiner* — Victor Batson
*Assistant Examiner* — Emily Morgan
(74) *Attorney, Agent, or Firm* — Fay Sharpe LLP

(57) ABSTRACT

A counterbalance assembly for an appliance hinge includes a base including first and second spaced-apart side walls and a transverse face wall. The base includes: (i) a channel located between the first and second side walls; and, (ii) a notch comprising first and second notch portions respectively located in said first and second side walls. A rotating cam is supported on the base. The cam includes: (i) a camshaft that extends between the side walls and that is adapted for rotation about an axis of rotation, with a first end of the camshaft located in the first notch portion and a second end of the camshaft located in the second notch portion; and, (ii) a lobe that projects from the camshaft. The hinge assembly includes a biasing spring that comprising an inner end engaged with the base and an outer end spaced from the base. The outer end of said spring is located outside the channel. A spring rod includes an outer end operatively coupled to the spring and an inner end operatively coupled to the lobe of the cam such that the spring biases the spring rod to an extended position.

4 Claims, 7 Drawing Sheets

APPLIANCE HINGE COUNTERBALANCE ASSEMBLY

CROSS-REFERENCE TO RELATED APPLICATION

This application claims priority from and benefit of the filing date of U.S. provisional patent application Ser. No. 61/150,144 filed Feb. 5, 2009, and said provisional application is hereby expressly incorporated by reference into the present specification.

BACKGROUND

Hinges for top-loading appliances such as washing machines and dryers must include or be operatively connected to a counterbalance assembly that provides a desired counterbalance effect such that the lid/door requires no more than a select amount of force to open, stays open without external support when fully opened, self-closes by gravity without harsh slamming against the appliance body when the lid/door is moved to a select partially closed position, and remains closed during normal operating conditions of the appliance. The counterbalance assembly must fit in a limited area and be designed to operate even after prolonged and repeated exposure to water, soap, bleach, heat, etc. A need has been identified for a new and improved appliance lid/door hinge counterbalance assembly that meets the above-noted design requirements while providing structural and functional advantages over known designs.

SUMMARY

In accordance with the present development, a counterbalance assembly for an appliance hinge includes a base including first and second spaced-apart side walls and a transverse face wall. The base includes: (i) a channel located between the first and second side walls; and, (ii) a notch comprising first and second notch portions respectively located in said first and second side walls. A rotating cam is supported on the base. The cam includes: (i) a camshaft that extends between the side walls and that is adapted for rotation about an axis of rotation, with a first end of the camshaft located in the first notch portion and a second end of the camshaft located in the second notch portion; and, (ii) a lobe that projects from the camshaft. The counterbalance assembly includes a biasing spring that comprises an inner end engaged with the base and an outer end spaced from the base. The outer end of said spring is located outside the channel. A spring rod includes an outer end operatively coupled to the spring and an inner end operatively coupled to the lobe of the cam such that the spring biases the spring rod to an extended position.

DETAILED DESCRIPTION

Figure 1:
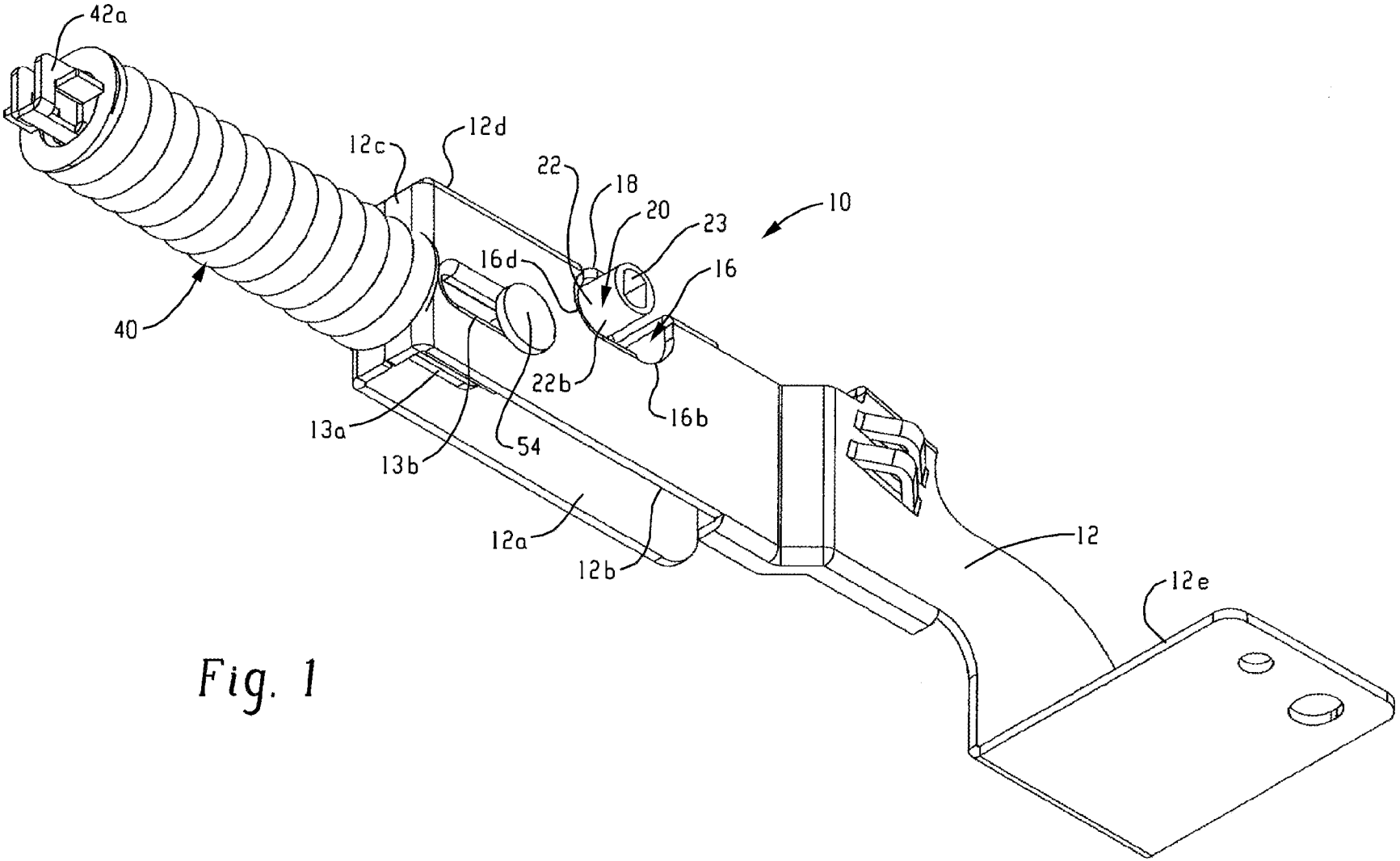
FIGS. 1 and 2 are first and second isometric views of an appliance hinge counterbalance assembly formed in accordance with the present development, with the counterbalance assembly shown in a first operative position corresponding to a lid/door of the appliance being closed.
Figure 2:
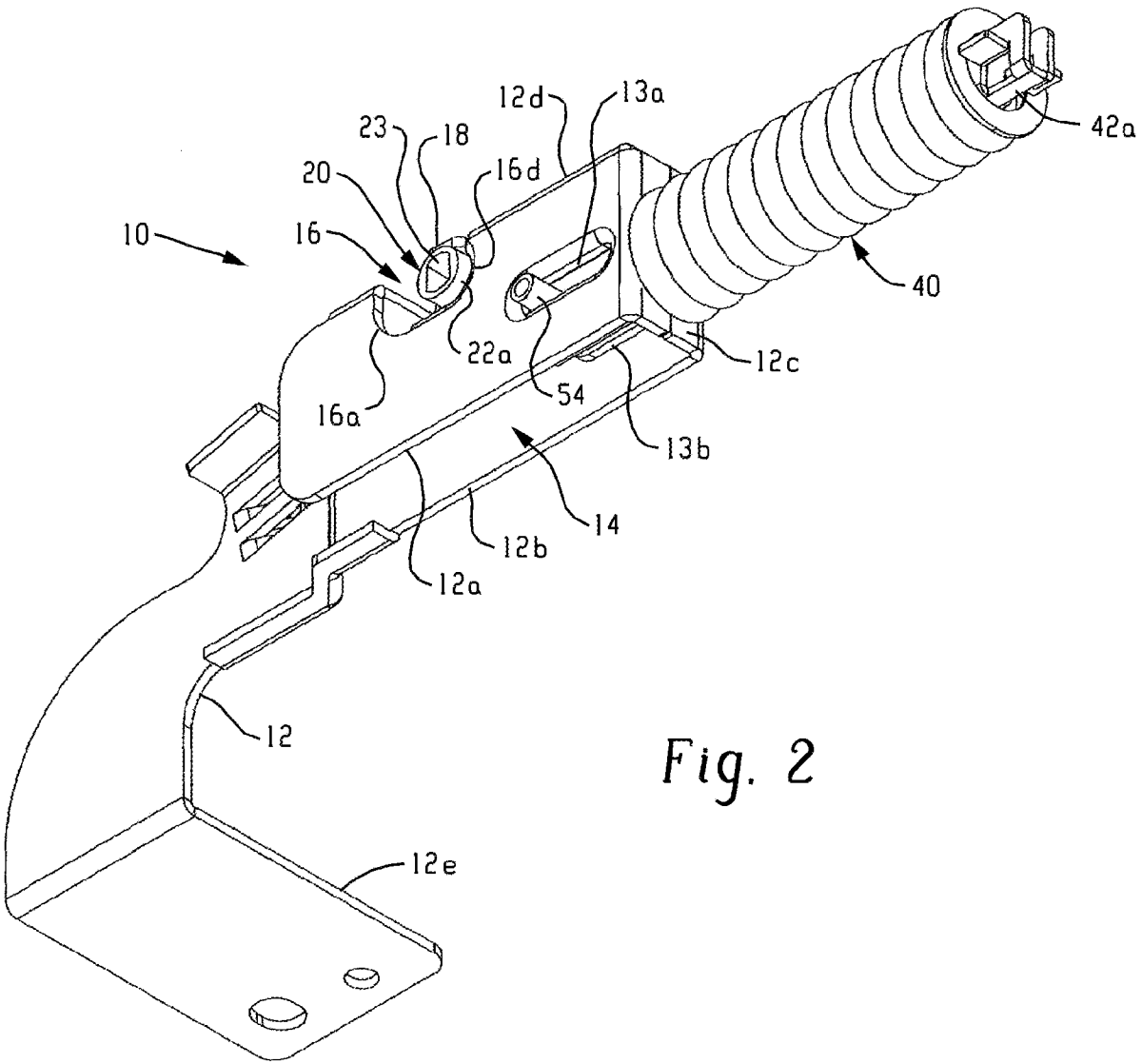

Referring to FIGS. 1-4A, the counterbalance assembly 10 is particularly adapted for operative connection to an associated hinge arm that pivotally secures an appliance lid/door to an appliance body. For example, the counterbalance assembly 10 is adapted for operative connection to a hinge arm used for pivotally securing a lid/door of a top-loading washing machine or dryer to the body of the washing machine or dryer. The counterbalance assembly 10 comprises a base 12 defined from a one-piece metal stamping or a multi-piece assembly of metal or other components or other like structure. The base 12 includes first and second longitudinally extending, parallel and spaced-apart side walls 12*a*,12*b* that typically lie in respective vertical planes when the counterbalance assembly 10 is operatively connected to a washer or other top-loading appliance. A channel 14 is defined between the side walls 12*a*,12*b* and is closed at one end by a transverse face wall 12*c*. The base 12 also includes a top wall 12*d* that extends between the side walls 12*a*,12*b*. The base 12 further includes at least one mounting tab 12*e* or other mounting structure adapted to be secured to an appliance body using one or more fasteners such as screws or rivets, or by a weld or other means.

A rotating cam 20 is operably supported on the base 12 and includes a cylindrical camshaft 22 that extends between the side walls 12*a*,12*b* through the channel 14 and that is adapted for rotation about its longitudinal axis of rotation X (FIG. 3) that extends transverse to the side walls 12*a*,12*b*. More particularly, the base 12 defines a notch 16 that opens in the top wall 12*d* and the side walls 12*a*,12*b*. The notch 16 comprises first and second notch portions 16*a*,16*b* defined respectively in the first and second side walls 12*a*,12*b*. First and second opposite ends 22*a*,22*b* of the camshaft 22 are rotatably supported by the first and second notch portions 16*a*,16*b*, respectively. The top wail 12*d* includes a keeper tab 18 (see also FIG. 4) that projects into the notch 16 so that a dwell point 16*d* for the cam shaft 22 is defined in the notch 16. The keeper tab 18 captures the first and second camshaft ends 22*a*,22*b* respectively in the first and second notch portions 16*a*,16*b* so that when the camshaft is seated in the notch dwell point 16*d*, the camshaft 22 is prevented from escaping the notch 16 during normal operation of the counterbalance assembly.

At least one or both opposite ends 22*a*,22*b* of the camshaft 22 are adapted to be connected to an associated wire-form or other associated appliance lid/door mounting hinge arm 30 (shown in broken lines in FIG. 3) such that the hinge arm 30 and camshaft 22 rotate together on the axis of rotation X. The wire-form or other appliance lid/door mounting hinge arm 30 can alternatively be provided as part of the counterbalance assembly 10. As shown herein, the hinge arm 30 is supplied separately (e.g., as part of the associated appliance). The hinge arm 30 is adapted for connection to an appliance lid/door using fasteners or other means. In the illustrated embodiment, the opposite ends 22*a*,22*b* of the camshaft 22 include respective non-circular recesses 23 that are adapted for close sliding insertion of a mating non-circular portion of the associated hinge arm 30 in a non-rotatable or keyed manner, but other connections between the hinge mounting arm 30 and the camshaft 22 can be used.

Figure 4:
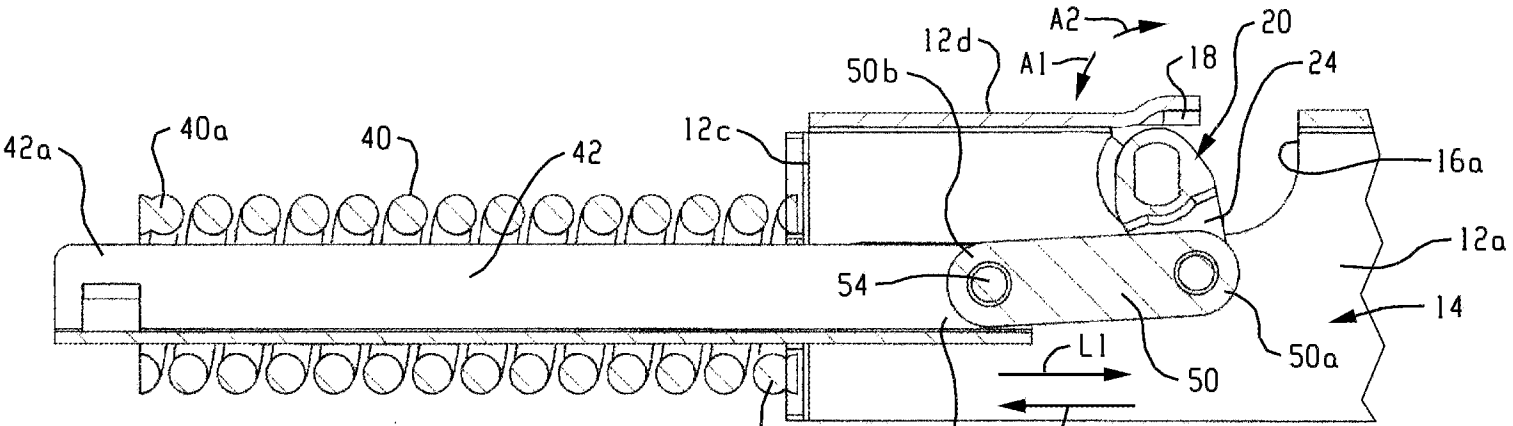
FIG. 4 is a section view as taken along view line 4-4 of FIG. 3.

The counterbalance assembly 10 further comprises a biasing spring 40 operatively connected/coupled to the rotating cam 20 for controlling rotational movement of the cam. In the illustrated embodiment, the spring 40 is a helical coil spring having an outer end 40*a* spaced from the base face wall 12*c*, external to the channel 14, and an opposite inner end 40*b* operably abutted or otherwise engaged with the face wall 12*c* or other part of the base 12 (via direct abutment or indirect abutment through a thrust washer or the like). A spring rod 42 extends coaxially through the spring 40, and an outer end 42*a* of the spring rod is operatively engaged/coupled to the outer end of the spring 40*a*, e.g., by deforming the outer end 42*a* of the spring rod and/or by including a washer or other enlarged member or portion on the outer end 42*a* of the spring rod 42, so that the outer end 42*a* cannot pass through the hollow core region or inside diameter of the spring 40. The spring rod 42 also extends through an opening in the face wall 12*c* of the base 12 such that an inner end 42*b* of the spring rod is located in the channel 14. The inner end 42*b* of the spring rod is operatively coupled to the rotating cam 20 through a connecting link 50. As shown in FIG. 4, rotation of the cam 20 about its axis X in first and second angular directions A1,A2 results in corresponding linear translation of the spring rod in corresponding first and second linear directions L1,L2.

Figure 3:
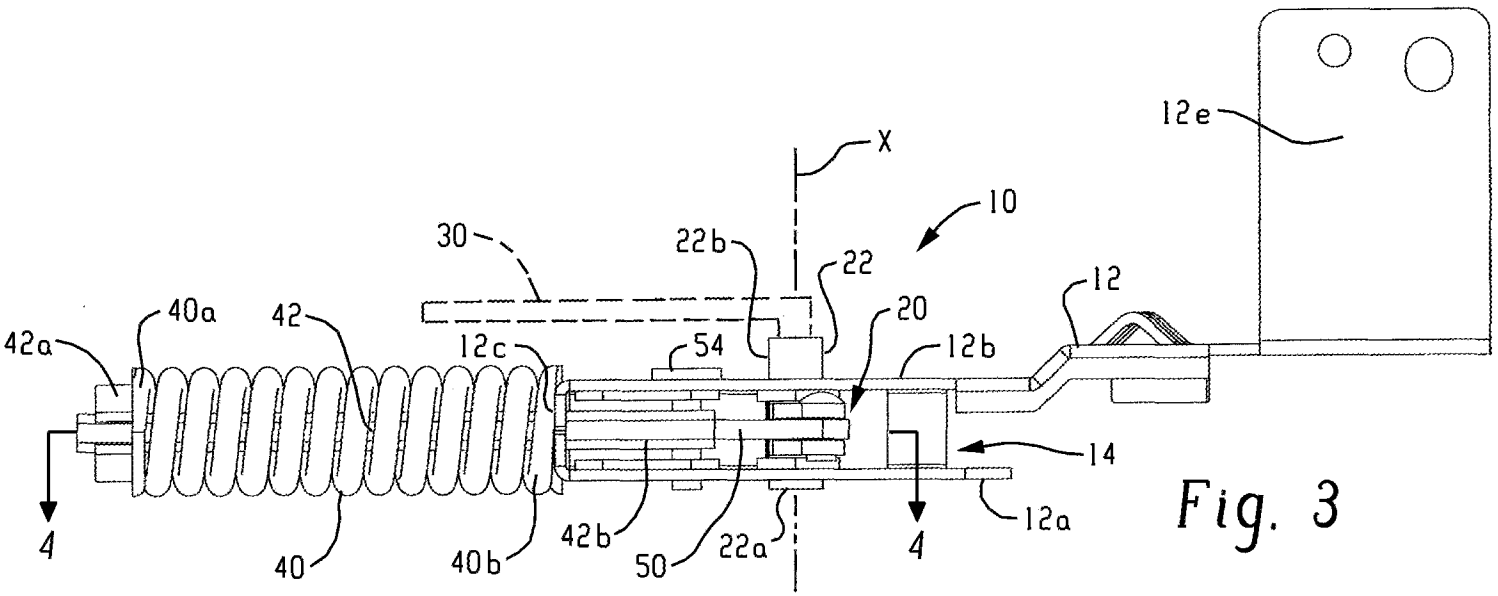
FIG. 3 is a bottom view of the counterbalance assembly of FIGS. 1 and 2.

With continuing reference to FIGS. 3 and 4, the rotating cam 20 includes a radially projecting tab or lobe 24 located in the channel 14 between the base side walls 12*a*,12*b*. The inner end 42*b* of the spring rod 42 is operatively coupled to the lobe 24 of the cam 20 by the connecting link 50 that has a first end 50*a* pivotally connected to the cam lobe 24 a second end 50*b* pivotally connected to the inner end 42*b* of the spring rod 42. The pivoting connections between the connecting link 50 and the arm 24 and spring rod 42 can be made using rivets or other fasteners or by other means such as direct engagement between mating portions of the components. The spring 40 biases the spring rod 42 to an extended position in which the outer end 42*a* of the spring rod 42 is spaced a maximum distance from the face wall 12*c* of the base 12.

Figure 4A:
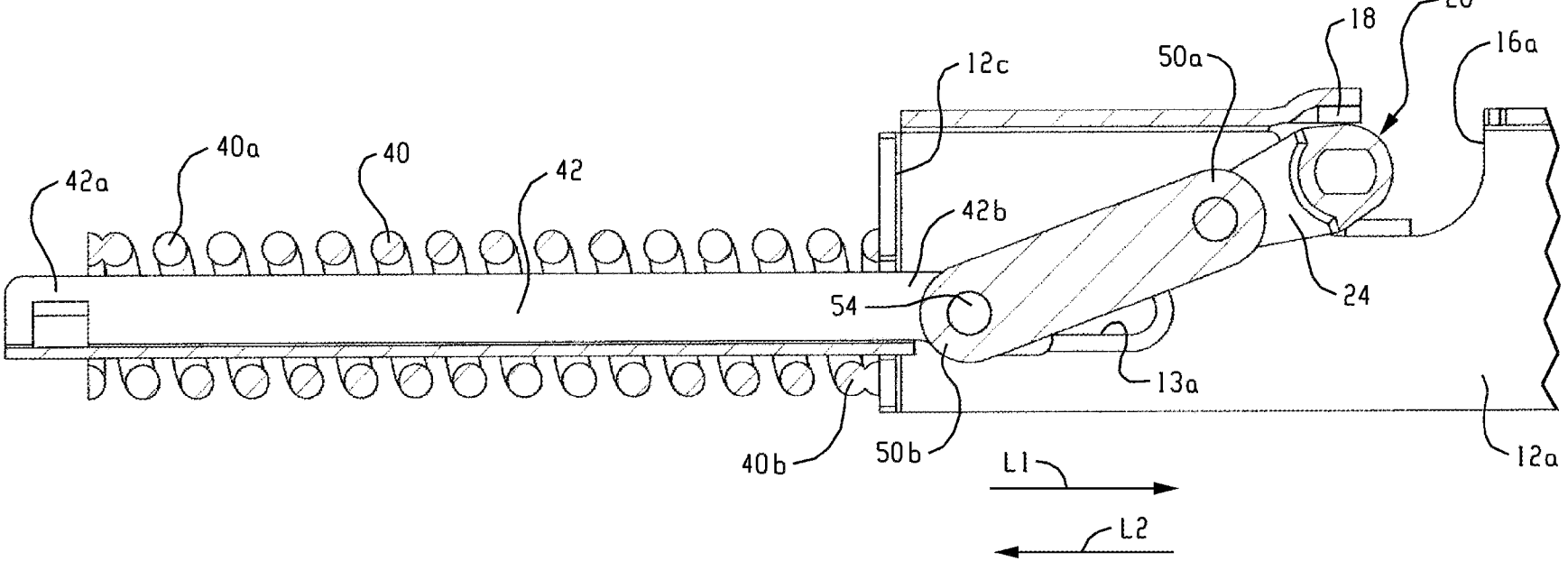
FIG. 4A is similar to FIG. 4 but shows the counterbalance assembly in a second operative position corresponding to the appliance lid/door being opened.

Referring to FIGS. 4 and 4A, rotational movement of the cam 20 about its longitudinal axis X in the first angular direction A1 (in response to closing movement of the appliance lid/door to which the mounting hinge arm 30 is connected) will induce inward sliding translation of the spring rod 42 in the direction L1 into the channel 14 against the biasing force of the spring 40 so that the outer end 42*a* of the spring rod 42 is moved toward the transverse wall 12*c* and compresses the coils of spring 40, which corresponds to a first operative position of the counterbalance assembly 10 as shown in FIG. 4. Rotational movement of the cam 20 in an opposite angular direction A2 during opening of the appliance lid/door to which the lid/door mounting hinge arm 30 is connected will be aided by the resilient biasing force of the spring 40 which assists sliding translational movement of the spring rod 42 in the direction L2 to its extended position where the outer end 42*a* of the spring rod is spaced a maximum distance from the transverse wall 12*c*, which corresponds to a second operative position of the counterbalance assembly 10 as shown in FIG. 4A. As such, the resilient elongation of the spring 40 assists opening movement of the associated appliance lid/door connected to the hinge arm 30 and the resilient compression of the spring 40 dampens closing movement of the associated lid/door.

In the illustrated embodiment, the inner end 42*b* of the spring rod is pivotally connected to the end 50*b* of the connecting link 50 by a rivet or other pivot fastener 54. The first and second body side walls 12*a*,12*b* include respective first and second elongated slots 13*a*,13*b* that are aligned with each other, and the pivot fastener 54 is slidably engaged in at least one and preferably both of the slots 13*a*,13*b*. As shown, the pivot fastener 54 includes opposite first and second ends that are respectively slidably engaged with the first and second elongated slots 13*a*,13*b*. The sliding engagement of the fastener 54 in the slots 13*a*,13*b* serves to stabilize and control movement of the spring rod 42 and cam 20 and limits the maximum inward and outward sliding movement of the spring rod 42 in the directions L1 and L2 (and thus limits the angular rotation of the cam 20 in the directions A1 and A2).

Figure 5:
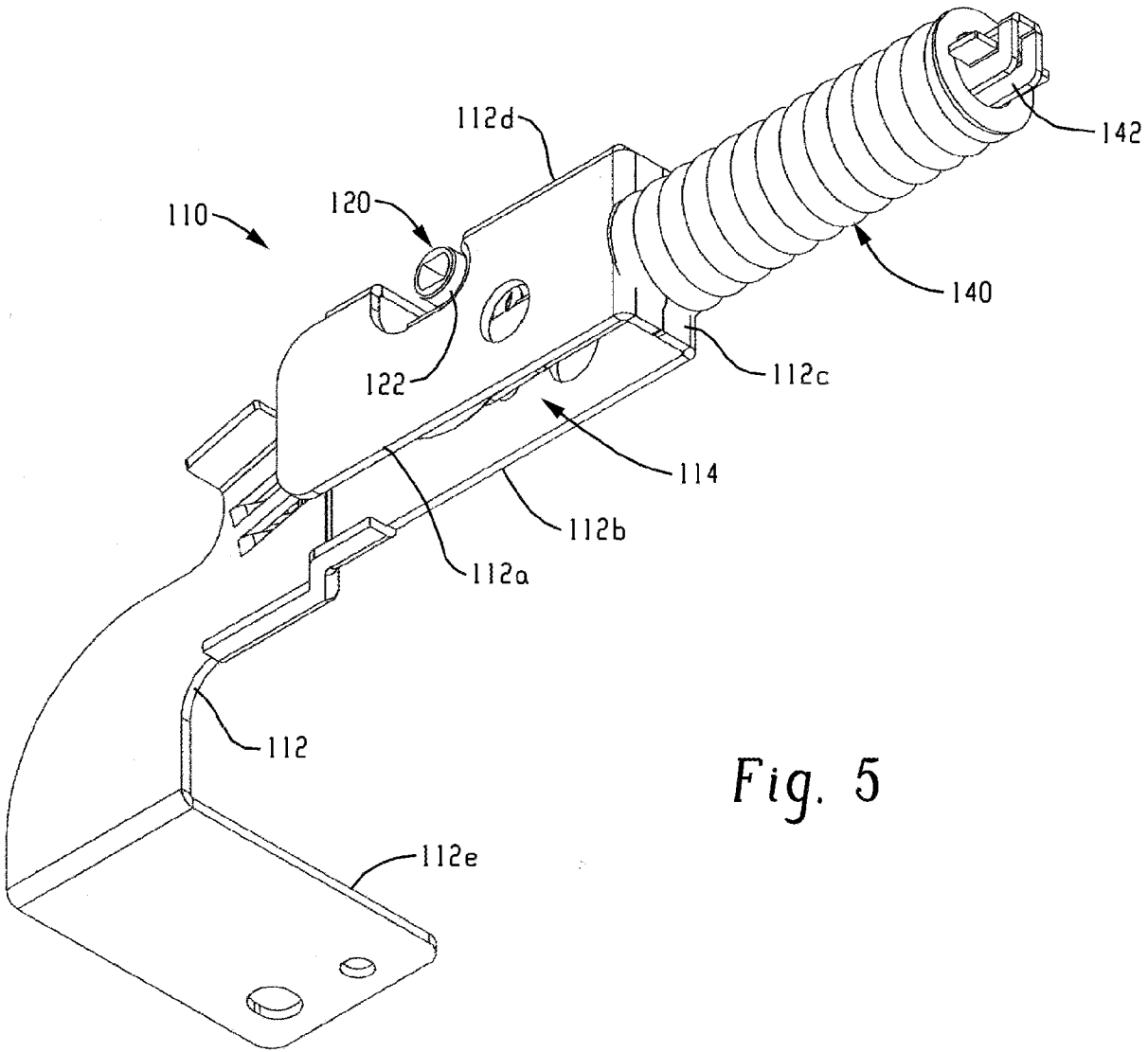
FIG. 5 is an isometric view similar to FIG. 2, but showing an alternative embodiment of an appliance hinge counterbalance assembly in accordance with the present development.
Figure 6:
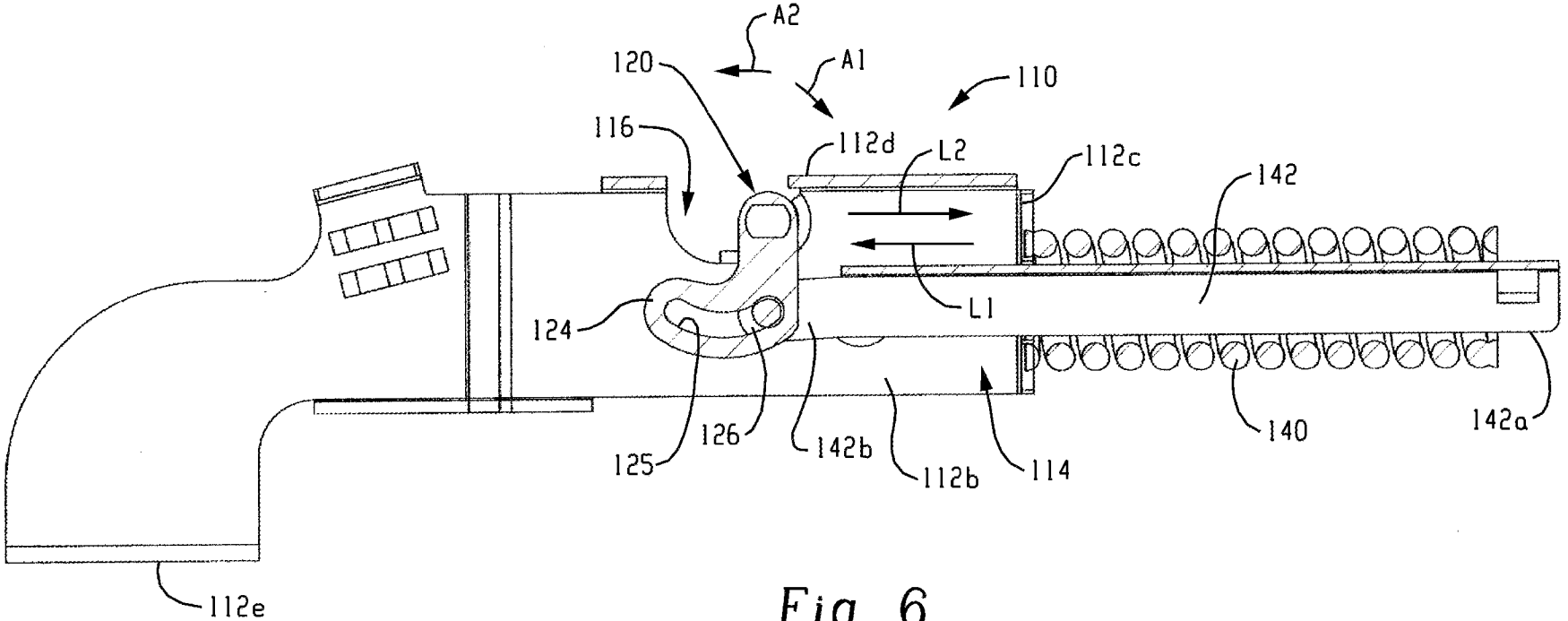
FIG. 6 is a section view taken at line 6-6 of FIG. 5.
Figure 6A:
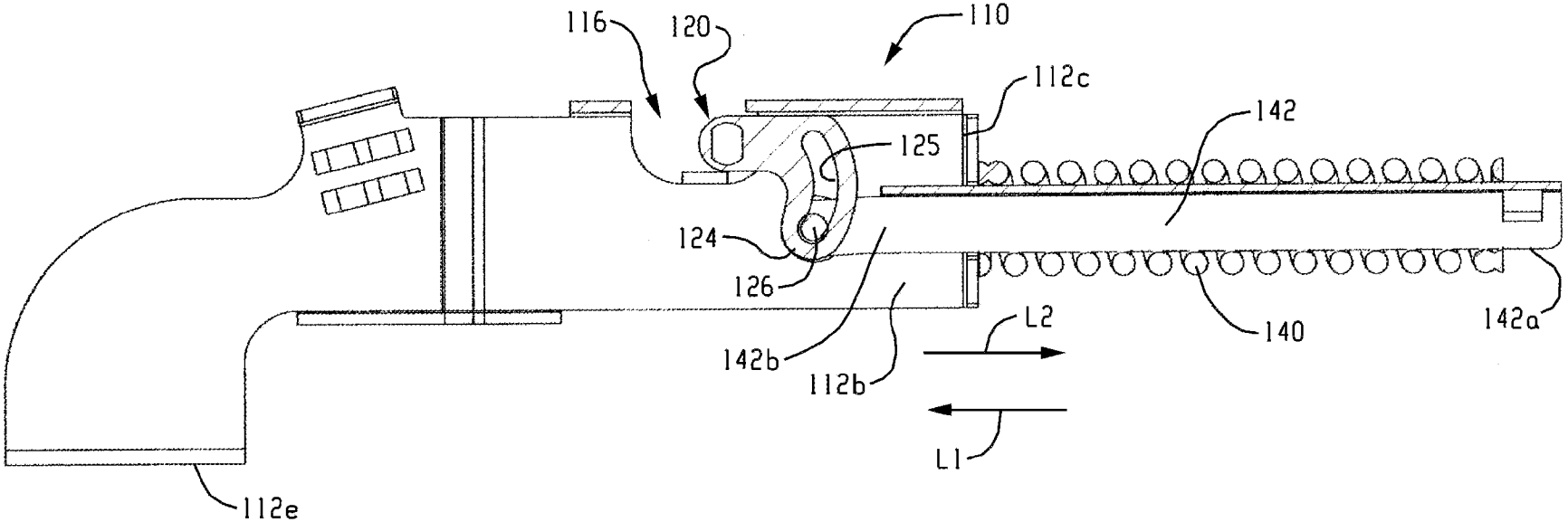
FIG. 6A is similar to FIG. 6 but shows the counterbalance assembly in a second operative position corresponding to the appliance lid/door being opened.

FIGS. 5, 6 and 6A illustrate and alternative embodiment counterbalance assembly 110 that is the same as the counterbalance assembly 10 except as otherwise shown and/or described herein. As such, like components are identified with like reference numbers that are 100 greater than those used above in relation to FIGS. 1-4 and are not described further here. In the counterbalance assembly 110, the lobe 124 of the cam 120 includes an elongated curved or arcuate slot 125, and the inner end 142*b* of the spring rod 142 is directly slidably connected to the lobe 124 with a sliding engagement between the spring rod inner end 142*b* and the slot 125, e.g., using a rivet 126 or other slide fastener. The slots 13*a*,13*b* of the base 12 from FIGS. 1-4 are not required because the elongated arcuate slot 125 of the cam lobe 124 limits travel of the spring rod 142 in the directions L1,L2. FIG. 6 shows a first operative position of the counterbalance assembly 110, which corresponds to the appliance lid/door being closed. FIG. 6A shows a second operative position of the counterbalance assembly 110, which corresponds to the appliance lid/door being opened.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A counterbalance assembly for an appliance hinge, said counterbalance assembly comprising:

a base including first and second spaced-apart side walls and a transverse face wall that extends between said first and second side walls, said base including: (i) a channel located between the first and second side walls, wherein said face wall closes one end of said channel; (ii) a notch comprising first and second notch portions respectively located in said first and second side walls; (iii) first and second elongated slots defined respectively in said first and second side walls; and, (iv) at least one mounting tab adapted to be connected to an associated appliance body;

a rotating cam supported on the base, said cam including: (i) a camshaft that extends between the side walls and rotates about a longitudinal axis of said camshaft, said camshaft comprising a first end located in said first notch portion and a second end located in said second notch portion; and (ii) a lobe that projects from the camshaft;

a biasing spring comprising an inner end engaged with the base and an outer end spaced from the base, said outer end of said spring located outside said channel;

a spring rod that extends through an opening in said face wall and including an outer end operatively coupled to the spring and an inner end operatively coupled to the lobe of the cam such that said spring biases said spring rod to an extended position, wherein said inner end of said spring rod is located in said channel and said outer end of said spring rod is spaced from said base such that said inner and outer ends of said spring rod are located on opposite sides of said transverse face wall, said spring rod operatively connected to the lobe of the cam by a connecting link, said connecting link including a first end pivotally connected to the cam lobe and a second end pivotally connected to the inner end of the spring rod by a pivot fastener, wherein opposite first and second ends of said pivot fastener respectively extend through and are adapted for reciprocal sliding movement in said first and second elongated slots of said base;

said spring comprising a helical coil spring and said spring rod extending coaxially through said spring, said inner end of said spring engaged with said transverse face wall of said base and said outer end of said spring is engaged with said outer end of said spring rod;

wherein:

rotational movement of the cam in a first angular direction about said longitudinal axis causes sliding movement of the spring rod in a first direction against a biasing force of the spring such that said spring rod is drawn inward into said channel through said face wall; and, rotational movement of the cam in a second angular direction about said longitudinal axis results in sliding movement of the spring rod in a second direction such that said spring rod is extended outward from said channel through said face wall.

2. The counterbalance assembly as set forth in claim 1, further comprising:

a hinge arm connected to the camshaft to rotate therewith, said hinge arm adapted to be connected to an associated appliance lid/door.

3. The counterbalance assembly as set forth in claim 1, wherein said base further comprises a top wall that extends between the first and second side walls, wherein said top wall comprises a keeper tab that captures said first and second ends of said camshaft in said first and second notch portions, respectively.

4. The counterbalance assembly as set forth in claim 1, wherein said outer end of said spring rod comprises an enlarged portion that prevents said outer end of said spring rod from sliding through said hollow core region of said spring.

* * * * *